US008333172B2

(12) United States Patent
Andris et al.

(10) Patent No.: US 8,333,172 B2
(45) Date of Patent: Dec. 18, 2012

(54) COOLING SYSTEM

(75) Inventors: Eric Andris, Chillicothe, IL (US); Bob Lindsey, Washington, IL (US); Curtis Johnson, Peoria, IL (US); Bruce Unger, Peoria, IL (US); Michael Betz, Knoxville, IL (US)

(73) Assignee: Caterpillar Inc., Peoria, IL (US)

( * ) Notice: Subject to any disclaimer, the term of this patent is extended or adjusted under 35 U.S.C. 154(b) by 542 days.

(21) Appl. No.: 12/654,478

(22) Filed: Dec. 22, 2009

(65) Prior Publication Data

US 2010/0155036 A1 Jun. 24, 2010

Related U.S. Application Data

(60) Provisional application No. 61/193,777, filed on Dec. 23, 2008.

(51) Int. Cl.
*F01P 5/10* (2006.01)
*F02B 41/00* (2006.01)
*F02B 67/00* (2006.01)

(52) U.S. Cl. ..... 123/41.44; 123/198 C

(58) Field of Classification Search ..... 123/41.44, 123/198 C

See application file for complete search history.

(56) References Cited

U.S. PATENT DOCUMENTS

| | | | | |
|---|---|---|---|---|
| 4,580,531 | A | 4/1986 | N'Guyen | |
| 6,178,928 | B1 | 1/2001 | Corriveau | |
| 6,374,780 | B1 | 4/2002 | Rutyna et al. | |
| 6,725,812 | B1 | 4/2004 | Scott | |
| 6,745,726 | B2 | 6/2004 | Joyce et al. | |
| 6,955,141 | B2 | 10/2005 | Santanam et al. | |
| 2004/0103862 | A1 | 6/2004 | Aidnik | |
| 2010/0083916 | A1 * | 4/2010 | Shintani et al. | 123/41.1 |

* cited by examiner

*Primary Examiner* — Nathaniel Wiehe
*Assistant Examiner* — Maria Aponte
(74) *Attorney, Agent, or Firm* — Finnegan, Henderson, Farabow, Garrett & Dunner LLP

(57) ABSTRACT

In one aspect, the present disclosure is directed to a method for controlling operation of an electric water pump configured to circulate a cooling fluid. The method may include detecting a startup of an electric power source associated with the electric water pump. In addition, the method may include monitoring a voltage available to the electric water pump in response to the detected startup of the power source. The method may also include providing an activation signal to the electric water pump if the monitored voltage is equal to or greater than a first threshold voltage.

20 Claims, 3 Drawing Sheets

COOLING SYSTEM

This application claims the benefit of U.S. Provisional Application No. 61/193,777, filed Dec. 23, 2008.

TECHNICAL FIELD

The present disclosure relates generally to a cooling system, and more particularly, to a cooling system including an electric water pump.

BACKGROUND

Machine engines may contain water pumps that circulate coolant from a radiator to engine components such as, for example, an engine cylinder block or a power conversion unit. The coolant circulated by the water pump is used to reduce excess heat on such engine components.

Current engine water pumps may be controlled by mechanical means such as, for example, a V-belt, a serpentine belt, or a timing belt. Such mechanical connections to a water pump may limit the placement and use of a water pump in an engine. For example, a water pump being driven by mechanical means may only be able to be placed near the mechanical connection. Furthermore, a water pump driven by mechanical means may have limitations with regard to variable speed operation. For example, a water pump driven mechanically may be limited to on or off states or may be limited to operate at speeds corresponding with the speed of the engine.

To overcome some of the limitations of mechanically driven water pumps, electrical water pumps have been developed and systems have been developed that control operation of such electrical water pumps. While cooling systems employing mechanically driven water pumps often require a radiator bypass for use when engine temperatures are low (because the pump is always running if the engine is running), electrical water pumps may be controlled to decrease rotor speed or stop operating if cooling is not desired (e.g., if the temperature parameter is below a given threshold temperature). For example, U.S. Pat. No. 4,580,531 (the '531 patent) discloses a system configured to leave the water pump off, after initial startup of the engine, until the engine reaches a predetermined threshold temperature.

While the '531 patent may disclose using a delay after engine startup before turning on the electric water pump, there are other considerations related to operation of electrical water pumps that are not addressed by the '531 patent. For example, in some cases, the electrical water pump may be supplied with electric power by a generator associated with the engine. When the engine is started, the generator may take several seconds to execute an initialization procedure. During the initialization of the generator, the electric water pump may receive a reduced voltage from the generator. It may be desirable to enable the generator to initialize without any unnecessary load. Furthermore, by waiting for operating systems to reach a predetermined threshold temperature, the '531 patent may be slow to react to, and/or slow to take advantage of, changed conditions, such as increases in voltage available to the electric water pump from the generator.

The disclosed system is directed to improvements in existing cooling systems.

SUMMARY

In one aspect, the present disclosure is directed to a method for controlling operation of an electric water pump configured to circulate a cooling fluid. The method may include detecting a startup of an electric power source associated with the electric water pump. In addition, the method may include monitoring a voltage available to the electric water pump in response to the detected startup of the power source. The method may include providing an activation signal to the electric water pump if the monitored voltage is equal to or greater than a first threshold voltage.

In another aspect, the present disclosure is directed to an electric water pump control system. The control system may include a controller configured to be communicatively coupled to an electric water pump. The controller may be configured to detect a startup of an electric power source associated with the electric water pump. The controller may also be configured to monitor a voltage available to the electric water pump from the power source in response to the detected startup of the power source. The controller may be configured to provide an activation signal to the electric water pump if the monitored voltage is equal to or greater than a first threshold voltage.

In another aspect, the present disclosure is directed to a cooling system. The cooling system may include an electric water pump configured to circulate a cooling fluid and a generator configured to supply power to the electric water pump. The cooling system may also include a controller communicatively coupled to the generator and the electric water pump. The controller may be configured to detect a startup of the generator. The controller may also be configured to monitor a voltage available to the electric water pump from the generator in response to the detected startup of the generator. The controller may be configured to provide an activation signal to the electric water pump if the monitored voltage is equal to or greater than a first threshold voltage.

DETAILED DESCRIPTION

Reference will now be made in detail to the drawings. Wherever possible, the same reference numbers will be used throughout the drawings to refer to the same or like parts.

Figure 1:
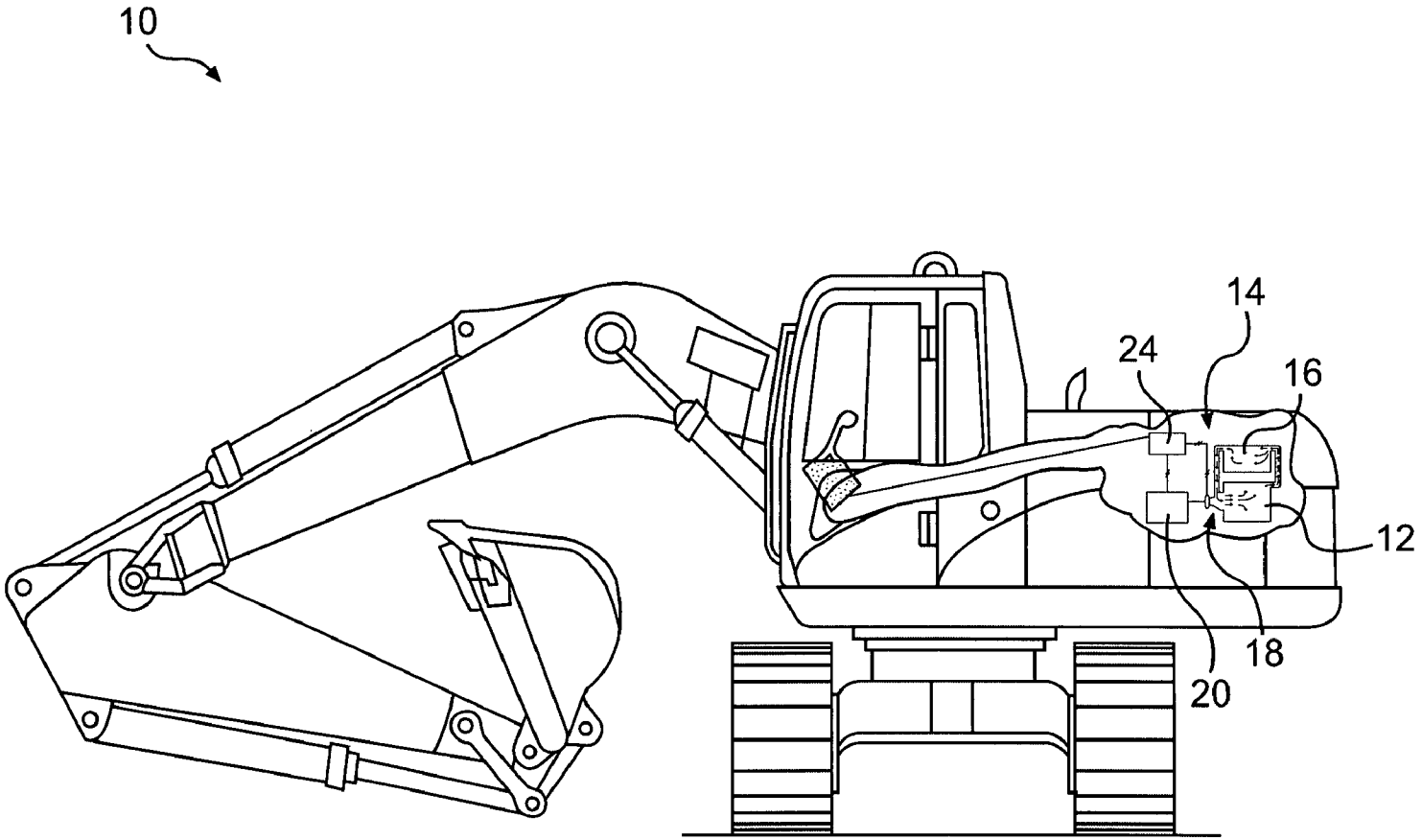
FIG. 1 is a diagrammatic illustration of machine having an exemplary disclosed cooling system.

FIG. 1 illustrates an exemplary machine 10. Although machine 10 is illustrated as an excavator in FIG. 1, machine 10 may be any type of machine that utilizes a water pump to cool various machine components. In some embodiments, machine 10 could be a stationary machine, such as an electric power generation set. Alternatively, machine 10 may be a mobile machine, such as a piece of construction equipment (e.g., excavator, bulldozer, etc.), an on-road or off-road vehicle (e.g. a dump truck, a passenger car, semi-trailer truck, bus, etc.), a locomotive, or a marine vessel.

Machine 10 may include an engine 12. Engine 12 may be any power producing device that can produce mechanical energy. For example, in some embodiments, engine 12 may be an internal combustion engine. Engine 12 may be any type of internal combustion engine such as, for example, a gasoline, diesel, or a gaseous fuel-powered engine. Engine 12 may include multiple subsystems that cooperate to produce an output of mechanical power. For example, engine 12 may include subsystems such as a fuel system, an air induction system, an exhaust system, a lubrication system, and a cooling system.

Figure 2:
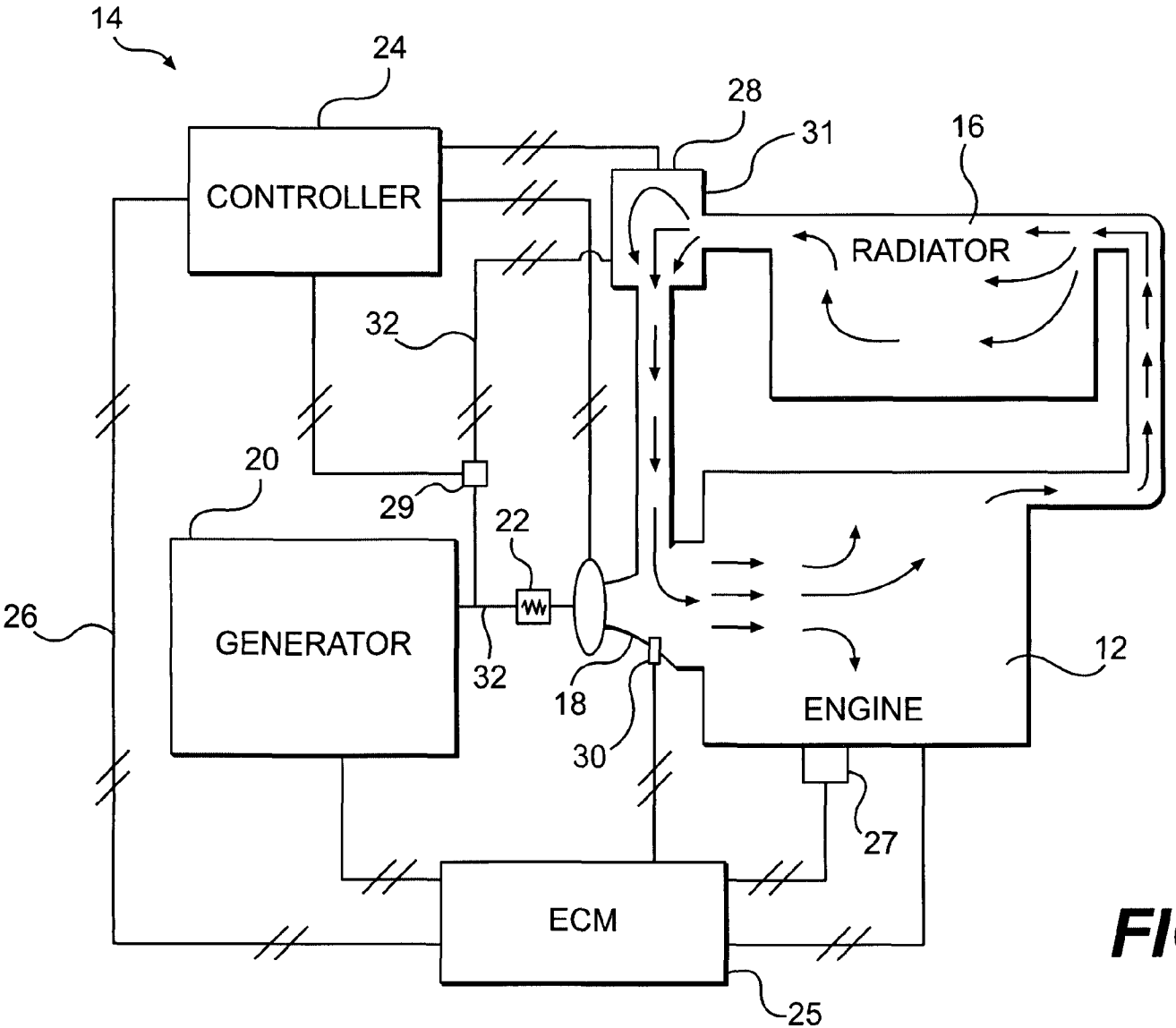
FIG. 2 is a diagrammatic illustration of an exemplary disclosed cooling system.

FIG. 2 illustrates an exemplary disclosed cooling system 14. Cooling system 14 may include, among other components, a heat exchanger 16 configured to remove thermal energy from a cooling fluid and an electric water pump 18 configured to circulate the cooling fluid between heat exchanger 16 and one or more components of machine 10 (e.g., an engine block, intercooler, electronics components, etc.). Cooling system 14 may also include an electric power source, herein referred to simply as a generator 20, which may be configured to supply electric power to one or more components of machine 10, including, in some embodiments, electric water pump 18. In some embodiments, cooling system 14 may include a power conversion unit (PCU) 22, which may be configured to convert, and condition, a flow of electrical current supplied by generator 20, and to be delivered to electric water pump 18. In addition, cooling system 14 may include a controller 24, which may be configured to control electric water pump 18 and, in some embodiments, other components.

Heat exchanger 16 may be any device configured to remove thermal energy from the cooling fluid in cooling system 14 and dissipate the heat, e.g., to the atmosphere. For example, in some embodiments, heat exchanger 16 may be embodied by, an air-to-liquid type of exchanger, such as, for example, a radiator.

Electric water pump 18 may include any electrically-powered fluid pumping device configured to circulate a cooling fluid between heat exchanger 16 and one or more components of machine 10. Electric water pump 18 may be configured to be operatively coupled to generator 20. In some embodiments, electric water pump 18 may be configured to operate on AC power. In other embodiments, electric water pump 18 may be configured to operate on DC power. Generator 20 may be configured to supply power to electric water pump 18. Accordingly, generator 20 may be configured to produce either AC or DC power, corresponding to the type of electric water pump paired with generator 20. Generator 20 may be configured to be mechanically powered by engine 12, and to convert at least a portion of that power into electricity. For example, generator 20 may be an alternating current synchronous generator, an induction generator, a permanent-magnet generator, a switched-reluctance generator, a three-phase alternating current generator, or any other type of generator suitable for converting mechanical power into electrical power and delivering electrical power to electric water pump 18. In some embodiments, generator 20 may include other power sources such as batteries, fuel cells, and/or externally connected power sources such as utility power sources or a dc power supply.

PCU 22 may be configured to convert and condition a flow of an electrical current from generator 20 to electric water pump 18. For example, PCU 22 may be configured to receive an input of fixed or variable frequency alternating current from generator 20, and then output a fixed or variable frequency alternating current and/or direct current. In another example, PCU 22 may be configured to power condition the flow of an electrical current from generator 20 by ensuring the electrical current is balanced, three phase, and sinusoidal. In some embodiments, PCU 22 may use power semiconductor devices such as, for example, diodes, thyristors, transistors, transformers, etc., to complete power conditioning, electrical current rectification, and/or electrical current inversion.

Controller 24 may be communicatively coupled to generator 20 and electric water pump 18. Controller 24 may include one or more computer mapping systems (not shown). The computer mapping system(s) may include, for example, tables, graphs, and/or equations for use in controlling various components of cooling system 14 and, in some embodiments, other systems of machine 10. Controller 24 may further include one or more other components or subsystems such as, for example, power supply circuitry, signal conditioning circuitry, and/or any other suitable circuitry for aiding in the control of one or more systems of machine 10.

In some embodiments, controller 24 may be a dedicated controller for electric water pump 18. In certain embodiments, controller 24 may be in communication with other electronic control modules (ECMs), such as ECM 25 via a common datalink 26. Such a configuration may enable controller 24 to communicate feedback, diagnostics, and command information with other ECMs. In other embodiments, controller 24 may control operation of other components besides electric water pump 18. For example, in some embodiments, controller 24 or ECM 25 may be an engine control unit (ECU) configured to control a variety of engine operating parameters. Further, Controller 24 and/or ECM 25 may be configured to collect data from a number of sensors, such as an engine speed sensor 27, a temperature sensor 28, a voltage sensor 29, a pump speed sensor 30, etc.

In some embodiments, controller 24 may be configured to control the operation of electric water pump 18 based on feedback data from one or more components of engine 12 and/or machine 10 that are being cooled by cooling fluid circulated by electric water pump 18. For example, controller 24 may be configured to receive measurements of parameters such as engine speed, cooling fluid temperature, power converter power loss, pump speed setting, ambient temperature, temperature of the cooled components themselves (e.g., an engine block and/or electronics components 31), etc. Electric water pump 18 may be controlled based on a function of one or more machine parameters such as those listed above. In some embodiments, pump speed may be continuously variable.

Controller 24 may be configured to control electric water pump 18 differently under differing operating conditions. In some embodiments, cooling system 14 may be configured to operate in a cold start mode. Upon a cold start of engine 12, the properties of the coolant circulated by electric water pump 18 may be different (e.g., more viscous) than when the coolant is at higher operating temperatures. Accordingly, controller 24 may be configured to delay activation of electric water pump 18 until the coolant has reached a predetermined temperature. In some embodiments, controller 24 may operate electric water pump 18 at a reduced output until the coolant reaches a predetermined temperature.

In addition, in some embodiments, controller 24 may be configured so that, under cold ambient temperatures, controller 24 may reduce output of electric water pump 18 to keep the temperature of controller semiconductors at lower operating temperatures. This may reduce the overall change in temperature experience by the semiconductors, which reduces stress on these components.

In addition, maximum power may not be available to electric water pump 18 immediately upon startup. For example, generator 20 may be configured to perform an initialization procedure at startup. The initialization procedure may include any of a number of processes that occur to set up the generator for operation, such as stabilization of the generator, calibration of sensors, current detection, ground fault detection, rotor position calibration, rotor/generator speed, voltage levels, etc. During this initialization procedure, the amount of power available to electric water pump 18 may be limited. In some embodiments, controller 24 may be configured to delay an activation signal, or provide an alternative control signal (e.g., to effectuate reduced output), to electric water pump 18 upon startup of generator 20 to allow generator 20 to execute an initialization procedure without an added draw from electric water pump 18. In some cases, a voltage less than a determined threshold voltage may be indicative that generator 20 is executing an initialization procedure. Accordingly, controller 24 may be configured to detect a state of generator 20, such as a startup of generator 20 and, in response to the detected startup of generator 20, controller 24 may monitor a voltage available to electric water pump 18 from generator 20. In order to delay the activation signal to electric water pump 18, controller 24 may be configured to wait to provide an activation signal to electric water pump 18 until the monitored voltage is equal to or greater than a first threshold voltage. In some embodiments, if the generator is not fully initialized or is operating at reduced capacity, controller 24 may be configured to operate electric water pump 18 at a reduced capacity.

In some embodiments, electric water pump 18 may be operatively coupled to generator 20 via a high voltage bus 32, as shown in FIG. 2. In such embodiments, the voltage monitored for purposes of implementing a delayed startup of electric water pump 18 may be the voltage of high voltage bus 32. Thus, controller 24 may be configured to receive voltage measurements of high voltage bus 32 and delay the sending of an activation signal to electric water pump 18 until high voltage bus 32 reaches a predetermined threshold voltage.

In certain embodiments, controller 24 may also have a secondary set of conditions that may trigger controller 24 to provide an activation signal to electric water pump 18. For example, controller 24 may also be configured to monitor an amount of time that has elapsed since the detected startup of generator 20. Controller 24 may provide an activation signal to electric water pump 18 if the monitored voltage is less than the first threshold voltage and the amount of time that has elapsed exceeds a threshold delay period. That is, controller 24 may be configured to delay the activation signal to electric water pump 18 for a sufficient time to allow the generator initialization procedure to execute. The threshold amount of elapsed time may vary from one machine to another, and may range from a few seconds to several minutes. Once enough time has passed to allow for the initialization procedure to be completed, controller 24 may provide the activation signal to electric water pump 18, even if the voltage detected has not exceeded the determined threshold.

In some embodiments, it may be desirable to provide cooling to certain components of cooling system 14 immediately upon machine startup. In such embodiments, controller 24 may be configured to operate electric water pump 18 in a derated mode until full bus voltage is reached or a specified time delay passes. For example, during the generator initialization procedure, when bus 32 is measured at a reduced voltage (e.g., 100V during the initialization procedure, compared to, for example, 340V during regular operation), controller 24 may be configured to control electric water pump 18 to operate at a reduced output. In some embodiments, controller 24 may be configured to run electric water pump 18 at a maximum output achievable using reduced available power (e.g., 100V). In other embodiments, controller 24 may be configured to run electric water pump 18 at a reduced output, which is lower than the maximum output possible using the reduced voltage available during initialization, for example, in order to limit draw on generator 20 during the initialization procedure.

Controller 24 may be configured to execute a control strategy for electric water pump 18 not only at initial startup and during normal operation, but also at shutdown of engine 12/generator 20 and thereafter. For example, in some embodiments, controller 24 may be configured to keep electric water pump 18 running for a determined amount of time after shutdown of generator 20, to thereby discharge high voltage bus 32. Alternatively, controller 24 may be configured to operate electric water pump 18 until high voltage bus 32 is discharged down to a threshold voltage. These strategies may discharge high voltage bus 32 more rapidly than, for example, by relying on bleeder resistors alone, thereby rendering high voltage bus 32, and components connected to it, serviceable more quickly.

Controller 24 may also be configured to perform advanced diagnostics on cooling system 14. For example, controller 24 may be configured to monitor system operating parameters to isolate shorts or faults in the electrical harness of machine 10. Also, in some embodiments, controller 24 may be configured to detect non-electrical fault conditions (such as cavitation, low fluid level, impeller obstructions, etc.) based on various monitored operating parameters (e.g., electrical current, temperature of cooling fluid, and pump output). Controller 24 may be configured to slow down, shut down, restart, or otherwise modify operation of electric water pump 18 in response to a detection of a fault condition. For example, if an obstruction prevents the normal startup of the electric water pump 18, controller 24 may be configured to reverse the pump impeller direction for a predetermined period of time in order to clear the obstruction. As another example, in an attempt to clear a cavitation condition, controller 24 may be configured to determine a condition of electric water pump 18 and/or determine one or more flow parameters of the cooling fluid circulated by electric water pump 18. In some embodiments, controller 24 may be configured to analyze recorded data such as these parameters and rule out cavitation, and accordingly infer that there is another fault condition, such as low coolant level. In other words, controller 24 may be configured to use a determination of the absence of certain fault conditions related to a given parameter to infer that certain other fault conditions exist.

INDUSTRIAL APPLICABILITY

The disclosed electric water pump control system may be applicable to any machine having a suitable electric power source (e.g., such as generator 20) and having components that may be cooled by a circulating cooling fluid. Exemplary such machines are mentioned above.

Figure 3:
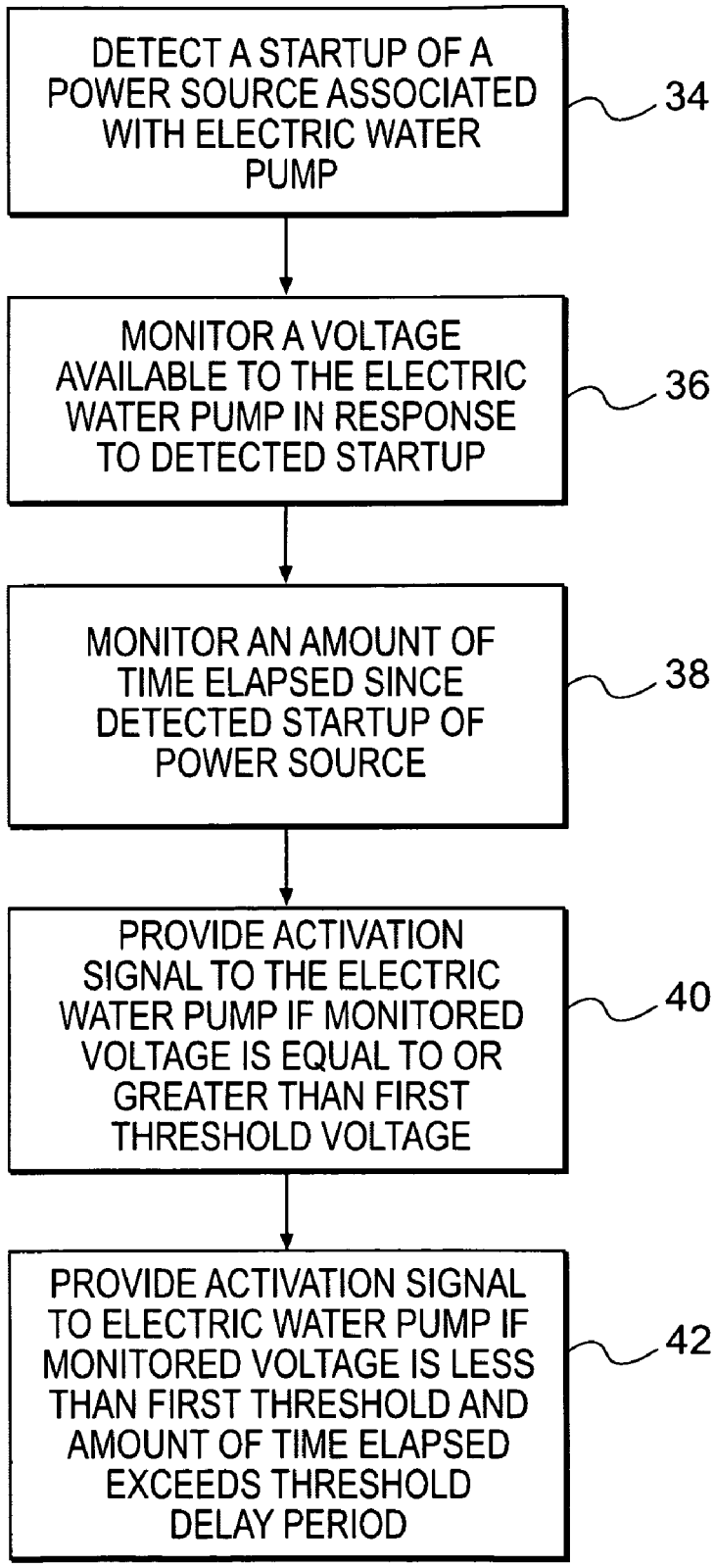
FIG. 3 is flowchart illustrating a method for controlling operation of an electric water pump.

FIG. 3 is a flowchart illustrating an exemplary method for controlling operation of electric water pump 18 to circulate cooling fluid. As shown in FIG. 3, the method may include detecting a startup of an electric power source (e.g., generator 20) associated with electric water pump 18. (Step 34.) The method may also include monitoring a voltage available to electric water pump 18 in response to the detected startup of the power source. (Step 36.) Also, as shown in step 38, the method may include monitoring an amount of time elapsed since the detected startup of the power source.

Controller 24 may provide an activation signal in response to one or more conditions. For example, in some embodiments, controller 24 may provide an activation signal to electric water pump 18 if the monitored voltage is equal to or greater than a first threshold voltage. (Step 40.) Also, controller 24 may provide activation signal to electric water pump 18 if the monitored voltage is less than the first threshold and the amount of time elapsed exceeds a determined threshold delay period. (Step 42.)

The monitored voltage exceeding the determined threshold may indicate that generator 20 has completed its initialization procedure and is providing more power that may be drawn by electric water pump 18 and other electronic components. By delaying the activation of electric water pump 20, and thus preventing an additional draw on generator 20, generator 20 may be able to execute the initialization procedure with more accuracy. The elapsed time threshold may ensure that electric water pump 18 is activated after the generator initialization procedure has been completed, regardless of whether generator 20 is providing more than the threshold voltage.

In some embodiments, the method may further include receiving measurements of a temperature of the cooling fluid and controlling the speed of electric water pump 18 based on the received temperature measurements. Also, the method may include receiving measurements of a temperature of the one or more components of the machine that are cooled by electric water pump 18, and controlling the speed of electric water pump 18 based on the received temperature measurements.

In addition, in embodiments wherein electric water pump 18 is operatively coupled to the electric power source via a high voltage bus (32), the method may further include keeping electric water pump 18 running for a determined amount of time after shut down of generator 20, thereby discharging high voltage bus 32. Operating electric water pump 18 for a determined amount of time after shut down of generator 20 and, thereby discharging high voltage bus 32 rapidly, may render high voltage bus 32, and components connected to it, serviceable more quickly after shutdown of engine 12. Also, the method may include converting and conditioning a flow of electrical current delivered from the electric power source to electric water pump 18 using a power conversion unit.

It will be apparent to those skilled in the art that various modifications and variations can be made to the disclosed cooling system. Other embodiments will be apparent to those skilled in the art from consideration of the specification and practice of the disclosed apparatus and method. It is intended that the specification and examples be considered as exemplary only, with a true scope being indicated by the following claims and their equivalents.

What is claimed is:

1. A method for controlling operation of an electric water pump configured to circulate a cooling fluid, comprising:

detecting a startup of an electric power source associated with the electric water pump;

monitoring a voltage available to the electric water pump in response to the detected startup of the power source; and providing an activation signal to the electric water pump if the monitored voltage is equal to or greater than a first threshold voltage.

2. The method of claim 1, further including:

monitoring an amount of time that has elapsed since the detected startup of the power source; and providing an activation signal to the electric water pump if the monitored voltage is less than the first threshold voltage and the amount of time that has elapsed exceeds a threshold delay period.

3. The method of claim 1, further including:

receiving measurements of a temperature of the cooling fluid; and controlling a speed of the electric water pump based on the received temperature measurements.

4. The method of claim 1, wherein the electric water pump is configured to circulate the cooling fluid to cool one or more components of a machine, the method further including:

receiving measurements of a temperature of the one or more components of the machine; and controlling a speed of the electric water pump based on the received temperature measurements.

5. The method of claim 1, wherein the electric water pump is operatively coupled to the electric power source via a high voltage bus, the method further including:

cooling one or more components of a machine using the electric water pump; and keeping the electric water pump running for a determined amount of time after shut down of the electric power source, thereby discharging the high voltage bus.

6. The method of claim 1, wherein the method includes:

removing thermal energy from a cooling fluid with a heat exchanger; and circulating the cooling fluid between the heat exchanger and one or more components of a machine.

7. The method of claim 1, further including converting and conditioning a flow of electrical current delivered from the electric power source to the electric water pump using a power conversion unit.

8. An electric water pump control system, comprising:

a controller configured to be communicatively coupled to an electric water pump, and configured to:

detect a startup of an electric power source associated with the electric water pump;

monitor a voltage available to the electric water pump from the power source in response to the detected startup of the power source; and provide an activation signal to the electric water pump if the monitored voltage is equal to or greater than a first threshold voltage.

9. The system of claim 8, wherein the controller is further configured to:

provide an activation signal to the electric water pump if the monitored voltage is less than the first threshold voltage and the amount of time that has elapsed exceeds a threshold delay period; and monitor an amount of time that has elapsed since the detected startup of the power source.

10. The system of claim 8, wherein the controller is further configured to:

receive measurements of a temperature of the cooling fluid; and control a speed of the electric water pump based on the received temperature measurements.

11. The system of claim 8, wherein the electric water pump is configured circulate cooling fluid to cool one or more components of a machine; and wherein the controller is further configured to:

receive measurements of a temperature of one or more components of a machine; and control a speed of the electric water pump based on the received temperature measurements.

12. The system of claim 8, wherein the electric water pump is operatively coupled to the electric power source via a high voltage bus; and wherein the controller is further configured to keep the electric water pump running for a determined amount of time after shut down of the electric power source to thereby discharge the high voltage bus.

13. A cooling system, comprising:

an electric water pump configured to circulate a cooling fluid;

an electric power source configured to supply power to the electric water pump; and a controller communicatively coupled to the electric power source and the electric water pump, the controller configured to:

detect a startup of the electric power source;

monitor a voltage available to the electric water pump from the electric power source in response to the detected startup of the electric power source; and provide an activation signal to the electric water pump if the monitored voltage is equal to or greater than a first threshold voltage.

14. The cooling system of claim 13, wherein the controller is further configured to:

monitor an amount of time that has elapsed since the detected startup of the electric power source; and provide an activation signal to the electric water pump if the monitored voltage is less than the first threshold voltage and the amount of time that has elapsed exceeds a threshold delay period.

15. The system of claim 13, wherein the controller is further configured to:

receive measurements of a temperature of the cooling fluid; and control a speed of the electric water pump based on the received temperature measurements.

16. The system of claim 13, wherein the cooling system is associated with a machine and is configured to cool one or more components of the machine.

17. The system of claim 16, wherein the controller is further configured to:

receive measurements of a temperature of the one or more components of the machine; and control a speed of the electric water pump based on the received temperature measurements.

18. The system of claim 13, wherein the electric water pump is operatively coupled to the electric power source via a high voltage bus; and wherein the controller is further configured to keep the electric water pump running for a determined amount of time after shutdown of the electric power source, to thereby discharge the high voltage bus.

19. The system of claim 13, further including a heat exchanger configured to remove thermal energy from the cooling fluid; and wherein the electric water pump is configured to circulate the cooling fluid between the heat exchanger and one or more components of a machine.

20. The system of claim 13, wherein a voltage less than the threshold voltage is indicative that the electric power source is executing an initialization procedure.

* * * * *